US007101018B2

(12) United States Patent
Yun

(10) Patent No.: US 7,101,018 B2
(45) Date of Patent: Sep. 5, 2006

(54) CAPPING APPARATUS FOR INK-JET PRINTHEAD

(75) Inventor: Suk-jin Yun, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 304 days.

(21) Appl. No.: 10/321,796

(22) Filed: Dec. 18, 2002

(65) Prior Publication Data

US 2004/0008236 A1 Jan. 15, 2004

(30) Foreign Application Priority Data

Jul. 12, 2002 (KR) ..... 10-2002-0040668

(51) Int. Cl.
*B41J 2/165* (2006.01)

(52) U.S. Cl. ..... 347/29

(58) Field of Classification Search ..... 347/22, 347/29, 33, 30, 32
See application file for complete search history.

(56) References Cited

U.S. PATENT DOCUMENTS 5,471,230 A * 11/1995 Saito et al. ..... 347/29
5,867,184 A 2/1999 Quintana ..... 347/29
6,203,136 B1 * 3/2001 Takahashi et al. ..... 347/32
6,406,123 B1 * 6/2002 Usui et al. ..... 347/29
6,817,695 B1 * 11/2004 Aldrich et al. ..... 347/29

FOREIGN PATENT DOCUMENTS

JP 11-70675 3/1999

* cited by examiner

*Primary Examiner*—Shih-Wen Hsieh
(74) *Attorney, Agent, or Firm*—Staas & Halsey LLP

(57) ABSTRACT

A capping apparatus for an ink-jet printhead protects a printhead of an ink-jet cartridge moved to a service station by a carriage during a standby mode. The apparatus includes a cap which seals the lower surface of the ink-jet cartridge surrounding the printhead, is spaced from the printhead by a predetermined gap and forms a sealed space; a cap holder which is connected to the lower portion of the cap and supports the cap; and a support portion which is connected to the lower portion of the cap holder and attaches to and detaches the cap and the cap holder from the lower surface of the ink-jet cartridge. A boss which penetrates the cap holder is formed in the cap, and an insertion element inserted into the boss to form a vent path to connect the sealed space to the outside.

18 Claims, 5 Drawing Sheets

CAPPING APPARATUS FOR INK-JET PRINTHEAD

CROSS-REFERENCE TO RELATED APPLICATIONS

This application claims the benefit of Korean Application No. 2002-40668, filed Jul. 12, 2002, in the Korean Intellectual Property Office, the disclosure of which is incorporated herein by reference.

BACKGROUND OF THE INVENTION

1. Field of the Invention

The present invention relates to a capping apparatus for an ink-jet printhead, and more particularly, to a capping apparatus which includes a vent path to connect to the outside a space in which a printhead of an ink-jet cartridge is sealed.

2. Description of the Related Art

A carrier which receives an ink-jet cartridge and reciprocates along a guide rod is provided in an ink-jet printer. The carrier reciprocates along the guide rod during printing. However, during a standby mode or when the carrier is not used for a long time, the carrier is moved to a service station provided at one side of the guide rod. In this case, the printhead of the ink-jet cartridge is sealed with a cap so as to prevent drying of ink in the nozzles, and contamination from dust.

However, when the printhead is sealed with the cap, when ambient temperature increases, the pressure in a sealed space formed between the printhead and the cap increases. Thus, the meniscus of the nozzles of the printhead is destroyed by the increased pressure in the sealed space, and printing quality deteriorates.

To solve this problem, as shown in FIG. 1, U.S. Pat. No. 5,867,184 discloses a universal cap 10 which seals a printhead (not shown) and has a vent path to connect a sealed space to the outside.

Referring to FIG. 1, a sealing lip 12 is positioned on a cap body 11. The sealing lip 12 forms a sealed space between the sealing lip 12 and the printhead while surrounding nozzles (not shown) of the printhead. In addition, although not shown, a groove is formed on the cap body 11 to which the sealing lip 12 is attached. The groove serves as a vent path and one end of the groove passes through the cap body 11 and connects the sealed space to the outside.

However, the universal cap 10 has a structure in which the sealing lip 12 is attached to the cap body 11. This structure is complicated, and thus it is difficult to manufacture the universal cap 10. Further, the area in which where the sealing lip 12 is attached to the cap body 11 is small. Thus, when the universal cap 10 is used for a long time, the sealing lip 12 may be detached from the cap body 11, and sealing of the printhead cannot be smoothly performed.

SUMMARY OF THE INVENTION

Accordingly, it is an object of the present invention to provide a capping apparatus for an ink-jet printhead which seals the ink-jet printhead, forms a simple vent path to connect a sealed space to the outside and does not cause sealing problems when the capping apparatus is used for a long time.

Additional objects and advantages of the invention will be set forth in part in the description which follows and, in part, will be obvious from the description, or may be learned by practice of the invention.

The foregoing and/or other objects are achieved by providing a capping apparatus which protects a printhead of an ink-jet cartridge moved to a service station by a carriage during a standby mode, the apparatus including a cap which seals a lower surface of the ink-jet cartridge surrounding the printhead, is spaced from the printhead by a predetermined gap, and forms a sealed space; a cap holder which is connected to a lower portion of the cap and supports the cap; a support portion which is connected to a lower portion of the cap holder and attaches to and detaches the cap and the cap holder from a lower surface of the ink-jet cartridge, wherein a boss which penetrates the cap holder is formed in the cap; and an insertion element inserted into the boss to form a vent path to connect the sealed space to an outside.

The insertion element may include a cylindrical column inserted into the boss, and a thread formed around the cylindrical column. The diameter of the cylindrical column may be smaller than the inner diameter of the boss, and the outer diameter of the insertion element including the thread may be larger than the inner diameter of the boss.

In addition, a head part is formed on the cylindrical column so as to cover the top portion of the boss, and a hole is formed in the head part. The hole is connected to a groove formed between the thread and an inner surface of the boss and connects the sealed space to the outside. The insertion element may be formed spirally.

The insertion element according to a modified example may be a cylindrical column in the outer wall of which a vertical groove is formed, or a cylindrical column in which a vertical through hole is formed. The cap may be formed of an elastomeric material, and the insertion element and the cap holder may be formed of a plastic material.

The boss may project a predetermined height toward the printhead. A hollow cylinder projecting toward the cap holder may be formed in the support portion, and an extrusion column may be formed under the cap holder. The extrusion column extends to the support portion and is inserted into the cylinder. An elastic spring may be formed around the cylinder to provide an elastic force so that the cap closely contacts the lower surface of the ink-jet cartridge.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
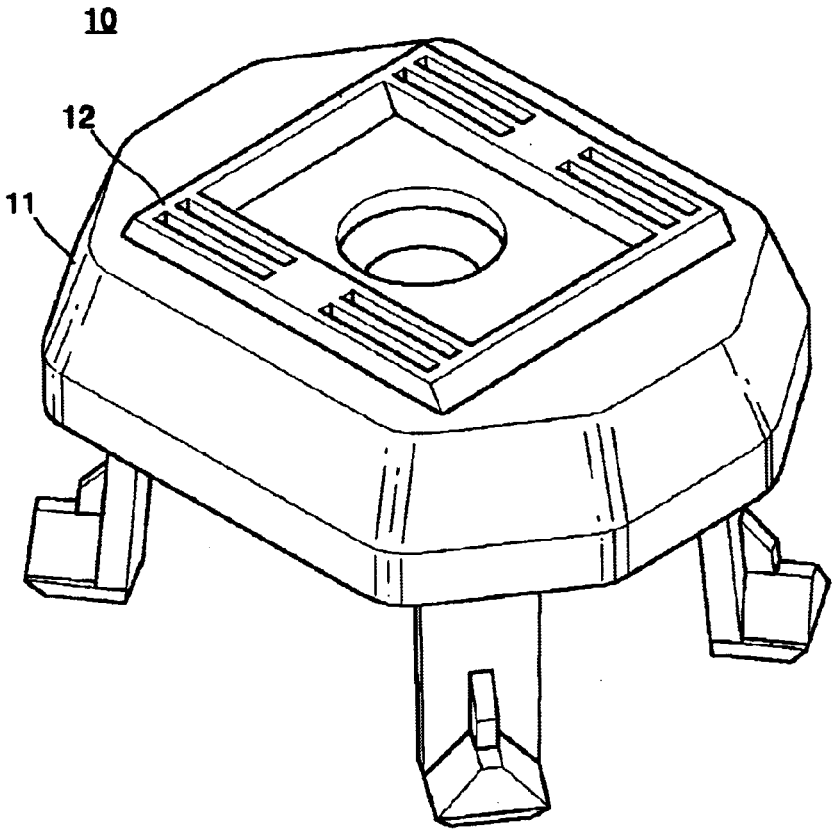
FIG. 1 (PRIOR ART)
FIG. 1 is a perspective view of a conventional universal cap.

Reference will now be made in detail to the present preferred embodiments of the present invention, examples of which are illustrated in the accompanying drawings, wherein like reference numerals refer to like elements throughout. In the drawings, the thicknesses of layers or regions are exaggerated for clarity.

Figure 2:
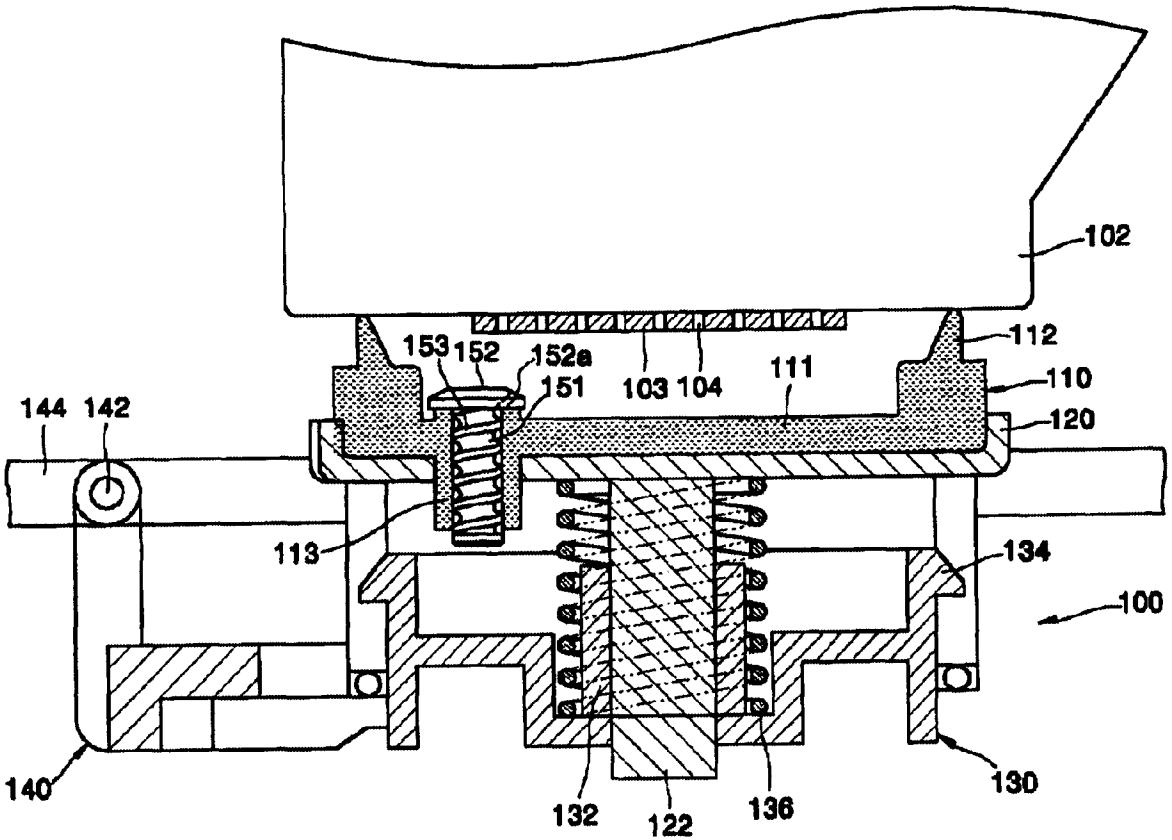
FIG. 2 is a cross-sectional view illustrating a capping apparatus for an ink-jet printhead according to an embodiment of the present invention which seals a printhead of an ink-jet cartridge.

FIG. 2 is a cross-sectional view illustrating a capping apparatus 100 for an ink-jet printhead according to an embodiment of the present invention which seals a printhead 103 of an ink-jet cartridge 102. Referring to FIG. 2, the printhead 103 is positioned on the lower surface of the ink-jet cartridge 102. A plurality of nozzles 104 through which ink is ejected are formed in the printhead 103. A cap 110 is spaced from the printhead 103 by a predetermined gap and surrounds the printhead 103. A cap holder 120, which supports the cap 110, is provided under the cap 110. A support portion 130, which supports the cap holder 120, is provided under the cap holder 120. An extrusion column 122 is formed under the cap holder 120. The extrusion column 122 is inserted into a hole of a cylinder 132 that is formed in the support portion 130, and is configured to move upward and downward through the hole of the cylinder 132. The downward movement of the extrusion column 122 is confined by a support jaw 134 formed at edges of the support portion 130 or the top portion of the cylinder 132. An elastic spring 136 is provided around the cylinder 132, provides an elastic force so that the cap holder 120 and the cap 110 move upward from the cylinder 132, and thus, the cap 110 seals the lower surface of the ink-jet cartridge 102.

The support portion 130 is connected to a mechanism (not shown) to move the support portion 130 so that the cap 110 contacts the lower surface of the ink-jet cartridge 102 when the inkjet cartridge 102 moves to a service station with a carriage (not shown) during a standby mode. In the present embodiment, the support portion 130 is connected to a rotation portion 140 and is attached to and is detached from the lower surface of the ink-jet cartridge 102 by the rotation portion 140. One side of the rotation portion 140 is fixed by a connection pin 142, the other side of the rotation portion 140 is connected to the support portion 130 and rotates centering on the connection pin 142. The connection pin 142 is fixed in a housing 144 that is provided for maintenance of a printer body or printhead. While a mechanism to rotate the support portion 130 is shown in the present embodiment, the support portion 130 may alternately be connected to a mechanism to move the support portion 130 upward and downward.

Figure 3:
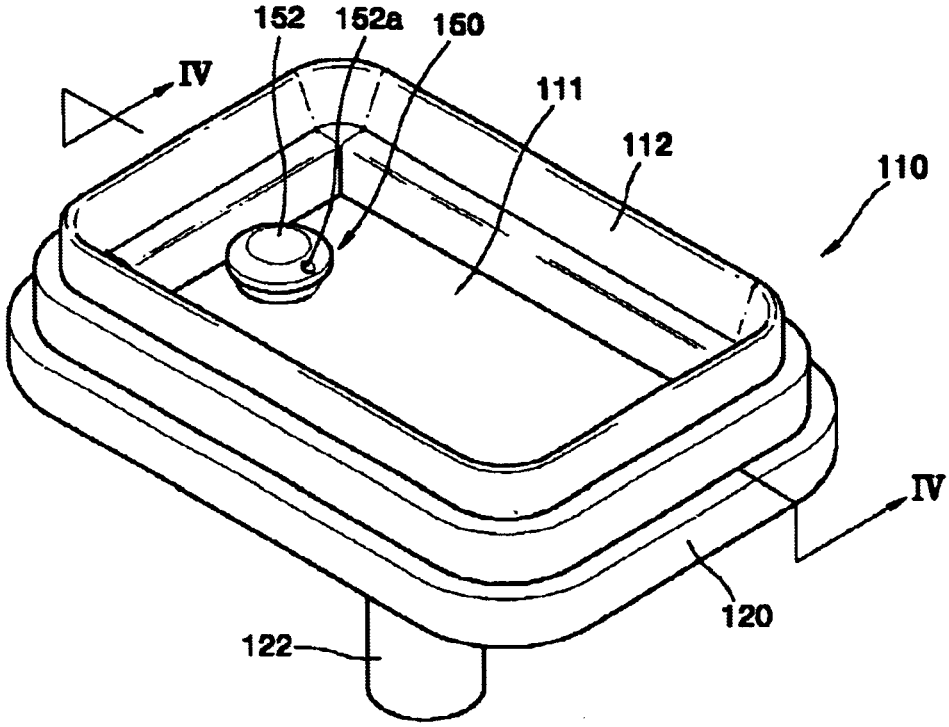
FIG. 3 is a perspective view illustrating portion of the capping apparatus of FIG. 2.
Figure 4:
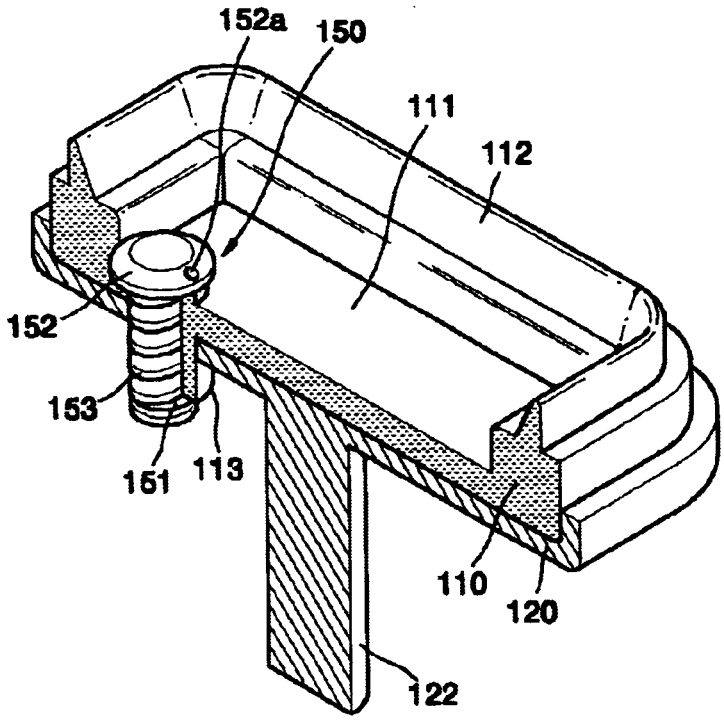
FIG. 4 is a cross-sectional view taken along line IV—IV of FIG. 3, showing a first type of insertion element.

FIG. 3 is a perspective view illustrating portions of the capping apparatus 100 of FIG. 2, and FIG. 4 is a cross-sectional view taken along line IV—IV of FIG. 3.

Referring to FIGS. 3 and 4, the cap 110 includes a plate 111 as a body, a sealing lip 112 which extends toward the ink-jet cartridge 102 from edges of the plate 111 and forms a sealed space surrounding the printhead 103, a boss 113 which is shaped to penetrate the plate 111, and an insertion element 150 which is inserted into the boss 113 and forms a vent path between an inner surface of the boss 113 and the insertion element 150.

The boss 113 is projected a predetermined height which is lower than the sealing lip 112 relative to the upper surface of the plate 111 and prevents waste ink and dust stacked on the plate 111 from flowing into the boss 113. In addition, the boss 113 projects to a predetermined length from the lower surface of the plate 111 downward and provides the length of the vent path, which is to be described later. A hole having a predetermined diameter is formed in the boss 113.

The insertion element 150 according to the present embodiment includes a cylindrical column 151, a thread 153 formed spirally around the cylindrical column 151, and a head part 152 formed on the cylindrical column 151.

The cap 110 may be formed of an elastomeric material such as rubber, and the insertion element 150 may be formed of a plastic material. The outer diameter of the cylindrical column 151 formed by the thread 153 is larger than the inner diameter of the boss 113, and the inner diameter of the cylindrical column 151 is smaller than the inner diameter of the boss 113. Thus, the insertion element 150 is inserted into the hole of the boss 113 and then forms the vent path spirally along the thread 153.

In the present embodiment, the inner diameter of the boss 113 is approximately 2.4 mm and the outer and inner diameters of the insertion element 150 are approximately 2.5 mm and 2.1 mm, respectively, and thus the height of the thread 153 is approximately 0.2 mm.

A hole 152*a* is formed in the head part 152 contacting the vent path and connects the sealed space formed by the cap 110 to the outside through the vent path. The cap holder 120 may be formed of a plastic material so that the elastic force from the spring 136 is conveyed to the cap 110.

The function of the capping apparatus 100 for an ink-jet printhead having the above structure will be described in detail with reference to the drawings.

Referring to the drawings, if the ink-jet cartridge 102 moves to the service station during a standby mode, the capping apparatus 100 connected to the connection pin 142 rotates, and the sealing lip 112 contacts the lower surface of the ink-jet cartridge 102. In this case, if the cap 110 and the cap holder 120 are moved downward by the ink-jet cartridge 102 and compress the spring 136, the extrusion column 122 moves slightly downward. In this case, the compressed depth of the inserted extrusion column 122 is confined by the support jaw 134 formed at the edges of the support portion 130. Thus, the compressed spring 136 provides an elastic force so that the cap 110 moves toward the lower surface of the ink-jet cartridge 102 from the support portion 130. Thus, the cap 110 forms the sealed space surrounding the printhead 103 on the lower surface of the ink-jet cartridge 102.

When the printer is not used for a long time, if an ambient temperature increases, the inner surface of the sealed space expands, and high pressure is generated. In this case, air in the sealed space flows into the hole 152*a* formed in the head part 152 of the insertion element 150, and is exhausted through the vent path. Thus, a predetermined range of pressure is maintained in the sealed space. As a result, the printhead 103 is protected from external temperature variations, and ink is normally ejected through nozzles 104 of the printhead 103 when the printer restarts.

Figure 5:
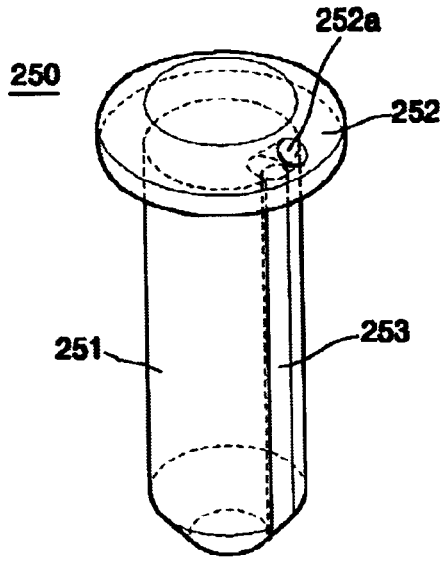
FIGS. 5 and 6 illustrate second and third types of insertion elements according to the present invention.

FIG. 5 illustrates another example of an insertion element.

Referring to FIG. 5, an insertion element 250 inserted into the boss 113 of the cap 110 includes a cylindrical column 251 in the outer wall of which a vertical groove 253 is formed, and a head part 252 formed on the cylindrical column 251. A hole 252*a* is formed in the head part 252 contacting the vertical groove 253 and connects the vent path formed between the inner surface of the boss 113 and the insertion element 250 to the sealed space. A diameter of the cylindrical column 251 is larger than an inner diameter of the boss 113, and a length obtained by subtracting a depth of the groove 253 from the diameter of the cylindrical column 251 is smaller than the inner diameter of the boss 113. As a result, the vertical groove 253 forms a well-sealed vent path when the insertion element 250 is inserted into the hole of the boss 113.

Figure 6:
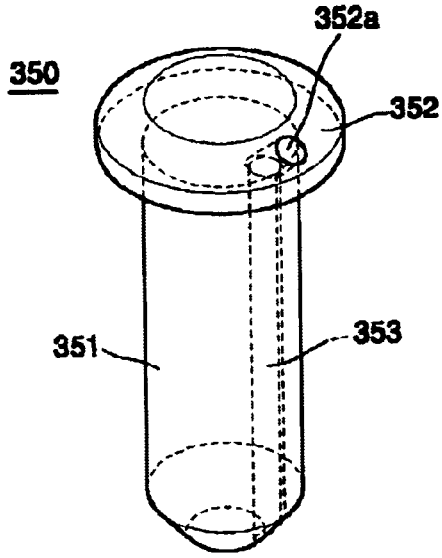

FIG. 6 illustrates another example of an insertion element.

Referring to FIG. 6, an insertion element 350 inserted into the boss 113 of the cap 110 includes a cylindrical column 351 in which a vertical through hole 353 is formed, and a head part 352 formed on the cylindrical column 351. A hole 352*a* is formed in the head part 352 contacting the through hole 353 and connects the vent path formed between the inner surface of the boss 113 and the insertion element 350 to the sealed space. The diameter of the insertion element 350 may be larger than the inner diameter of the boss 113. As a result, the through hole 353 forms the vent path when the insertion element 350 is inserted into the hole of the boss 113.

The functions of the insertion elements 250, 350 are similar to the function of the insertion element 150.

As described above, in the capping apparatus for an ink-jet printhead according to the present invention, the printhead of the ink-jet cartridge can be sealed, and simultaneously the vent path to connect the sealed space to the outside can be simply formed. In addition, the insertion element having a large outer diameter is inserted into the boss, thereby achieving an efficient seal.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A capping apparatus which protects a printhead of an ink-jet cartridge moved to a service station by a carriage during a standby mode, the apparatus comprising:

a cap which seals a lower surface of the ink-jet cartridge surrounding the printhead, is spaced from the printhead by a predetermined gap, and forms a sealed space;

a cap holder which is connected to a lower portion of the cap and supports the cap;

a support portion which is connected to a lower portion of the cap holder and attaches to and detaches from the cap and the cap holder from a lower surface of the ink-jet cartridge, wherein a boss which penetrates the cap holder is formed in the cap; and an insertion element fixedly installed inside the boss, to form a vent path to connect the sealed space to an outside.

2. The apparatus of claim 1, wherein the insertion element comprises:

a cylindrical column inserted into the boss; and a thread formed around the cylindrical column, and the thread forms the vent path.

3. The apparatus of claim 2, wherein a diameter of the cylindrical column is smaller than an inner diameter of the boss, and an outer diameter of the insertion element including the thread is larger than the inner diameter of the boss.

4. The apparatus of claim 2, wherein a groove is formed between the thread and an inner surface of the boss, and the insertion element comprises:

a head part formed on the cylindrical column so as to cover a top portion of the boss, and a hole is formed in the head part to connect to the groove and to connect the sealed space to the outside.

5. The apparatus of claim 4, wherein the insertion element is formed spirally.

6. The apparatus of claim 1, wherein the insertion element is a cylindrical column having an outer wall and a vertical groove formed on the outer wall, and the vertical groove forms the vent path.

7. The apparatus of claim 6, wherein a diameter of the cylindrical column is larger than an inner diameter of the boss, and a length obtained by subtracting a depth of the groove from the diameter of the cylindrical column, is smaller than the inner diameter of the boss.

8. The apparatus of claim 6, further comprising:

a head part formed on the insertion element to cover a top portion of the boss; and a hole, formed in the head part, which is connected to the groove and connects the sealed space to the outside.

9. The apparatus of claim 1, wherein the insertion element is a cylindrical column in which a vertical through hole is formed, and the vertical through hole forms the vent path.

10. The apparatus of claim 9, wherein a diameter of the cylindrical column is larger than an inner diameter of the boss before the installation of the insertion element inside the boss.

11. The apparatus of claim 9, further comprising:

a head part formed on the cylindrical column to cover a top portion of the boss; and a hole, formed in the head part, which is connected to the through hole and connects the sealed space to the outside.

12. The apparatus of claim 1, wherein the cap is formed of an elastomeric material, and the insertion element and the cap holder are formed of a plastic material.

13. The apparatus of claim 1, wherein the boss projects to a predetermined height toward the printhead.

14. The apparatus of claim 1, further comprising:

a hollow cylinder projecting toward the cap holder, formed in the support portion; and an extrusion column which extends to the support portion and inserted into the cylinder, the extrusion column being formed under the cap holder.

15. The apparatus of claim 14, further comprising an elastic spring formed around the cylinder to provide an elastic force so that the cap closely contacts a lower surface of the ink-jet cartridge.

16. A capping apparatus which protects a printhead of an ink-jet cartridge moved to a service station by a carnage during a standby mode, the apparatus comprising:

a cap which seals a lower surface of the ink-jet cartridge surrounding the printhead, is spaced from the printhead by a predetermined gap, and forms a sealed space;

a cap holder which is connected to a lower portion of the cap and supports the cap;

a support portion which is connected to a lower portion of the cap holder and attaches to and detaches from the cap and the cap holder from a lower surface of the ink-jet cartridge, wherein a boss which penetrates the cap holder is formed in the cap; and an insertion element inserted into the boss to form a vent path along a length of the vent path to connect the sealed space to an outside.

17. An apparatus to protect an ink-jet cartridge, the apparatus comprising:

a cap to contact the ink-jet cartridge to form a sealed space therebetween;

a press unit to press the cap against the ink-jet cartridge to maintain the sealed space; and a vent element inserted into the cap to form a vent path along a length of the vent element to connect the sealed space to an outside;

wherein the vent element extends a predetermined height above a lower inner surface of the cap.

18. A printing apparatus comprising:

an ink-jet cartridge;

a housing; and a capping apparatus to protect the ink-jet cartridge, the apparatus comprising:

a cap to contact the ink-jet cartridge to form a sealed space therebetween, a support portion in contact with the housing to support the cap, a press unit between the cap and the support portion to press the cap against the ink-jet cartridge to maintain the sealed space, and a vent element inserted into the cap to form a vent path along a length of the vent element to connect the sealed space to an outside;

wherein the vent element extends a predetermined height above a lower inner surface of the cap.

* * * * *

UNITED STATES PATENT AND TRADEMARK OFFICE

CERTIFICATE OF CORRECTION

PATENT NO. : 7,101,018 B2
APPLICATION NO. : 10/321796
DATED : September 5, 2006
INVENTOR(S) : Suk-jin Yun It is certified that error appears in the above-identified patent and that said Letters Patent is hereby corrected as shown below:

Column 6, Line 23, change “carnage” to --carriage--.

Signed and Sealed this

Thirtieth Day of January, 2007

JON W. DUDAS
*Director of the United States Patent and Trademark Office*